US008850733B1

(12) United States Patent
Oster

(10) Patent No.: US 8,850,733 B1
(45) Date of Patent: Oct. 7, 2014

(54) SAFETY SYSTEM ALLOWING PARTIAL ENABLEMENT OF SHOOTING FUNCTIONALITY UPON RECEPTION OF SIGNAL

(71) Applicant: Dylan Kyle Oster, Lake Oswego, OR (US)

(72) Inventor: Dylan Kyle Oster, Lake Oswego, OR (US)

( * ) Notice: Subject to any disclaimer, the term of this patent is extended or adjusted under 35 U.S.C. 154(b) by 0 days.

(21) Appl. No.: 13/890,242

(22) Filed: May 8, 2013

Related U.S. Application Data

(60) Provisional application No. 61/643,904, filed on May 8, 2012.

(51) Int. Cl.
*F41A 17/06* (2006.01)

(52) U.S. Cl.
CPC ..... *F41A 17/063* (2013.01)
USPC ..... 42/70.01

(58) Field of Classification Search
CPC ..... F41A 17/06; F41A 17/063; F41A 17/066; F41A 17/44; F41A 17/56; F41A 17/64; F41A 17/74
USPC ..... 42/70.01, 70.05, 70.06, 70.08
See application file for complete search history.

(56) References Cited

U.S. PATENT DOCUMENTS

| | | | | |
|---|---|---|---|---|
| 4,003,152 | A * | 1/1977 | Barker et al. | 42/70.01 |
| 4,375,135 | A | 3/1983 | Wigger | |
| 4,476,644 | A | 10/1984 | Laing | |
| 4,682,435 | A * | 7/1987 | Heltzel | 42/70.01 |
| 4,719,713 | A | 1/1988 | Hagle | |
| 4,739,569 | A | 4/1988 | Battle | |
| 4,829,692 | A | 5/1989 | Guild | |
| 5,183,951 | A | 2/1993 | Bilodeau | |
| 5,487,234 | A | 1/1996 | Dragon | |
| 5,560,135 | A | 10/1996 | Ciluffo | |
| 5,564,211 | A * | 10/1996 | Mossberg et al. | 42/70.11 |
| 5,603,179 | A | 2/1997 | Adams | |
| 5,713,149 | A | 2/1998 | Cady et al. | |
| 5,715,623 | A | 2/1998 | Mackey, III | |
| 6,785,996 | B2 | 9/2004 | Danner et al. | |
| 7,188,444 | B2 | 3/2007 | Danner et al. | |
| 7,506,468 | B2 | 3/2009 | Farrell et al. | |
| 2002/0112390 | A1 | 8/2002 | Harling et al. | |
| 2006/0242879 | A1 * | 11/2006 | Schmitter | 42/70.01 |

OTHER PUBLICATIONS

Glock "Safe Action" Pistols, © 2009 by Glock Ges.m.b.H., Glock Safety Pack, web site www.glock.com/english/index_safety.htm, 1 page.

Firearm Locks, Trigger Locks, Gun Locks: Frazen Security Products, Franzen Security Products, Inc., at least as early as May 9, 2013, web site www.franzenint.com/gun-and-firearm-locks.html, 2 pages.

* cited by examiner

*Primary Examiner* — Stephen M Johnson
(74) *Attorney, Agent, or Firm* — Law Office of Karen Dana Oster, LLC

(57) ABSTRACT

A safety system at least one transmitter and at least one receiver and at least one enabler/disabler associated with a firearm. The at least one transmitter emits a signal. The receiver is capable of receiving the signal from the transmitter. The enabler/disabler is at least partially enabling the firearm such that the firearm is available for shooting upon receipt of the controlling communication from the receiver, the receiver transmitting the controlling communication in response to the receipt of the signal from the transmitter.

20 Claims, 4 Drawing Sheets

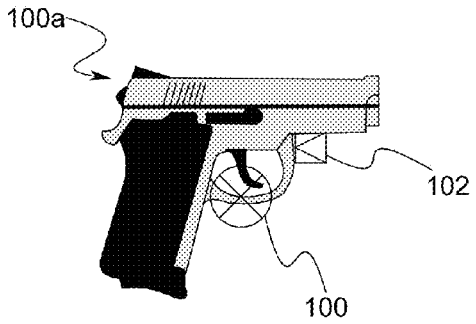
FIG. 2A
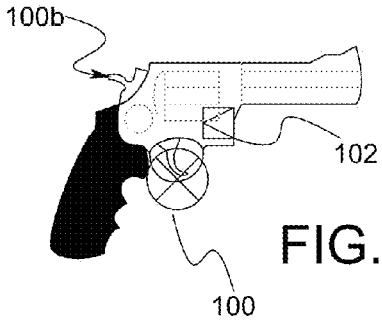
FIG. 2B
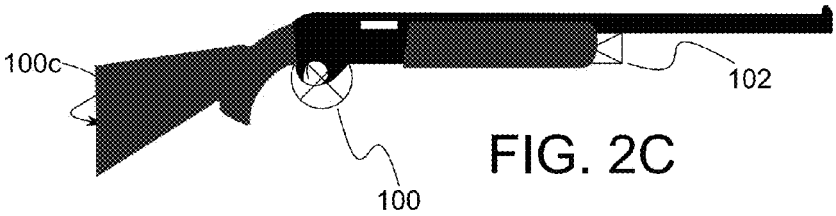
FIG. 2C
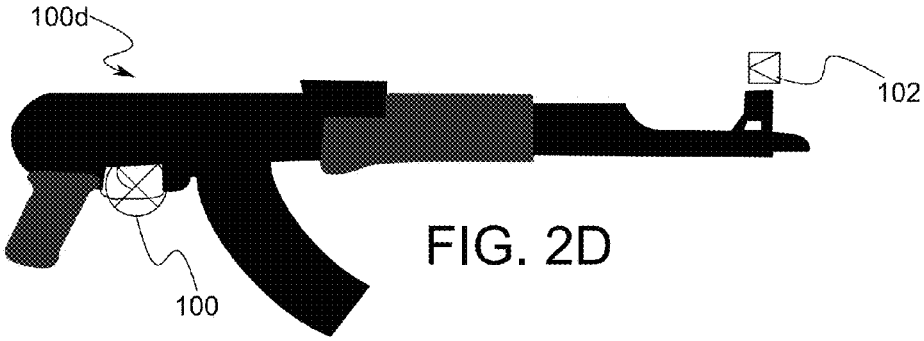
FIG. 2D
FIG. 2E
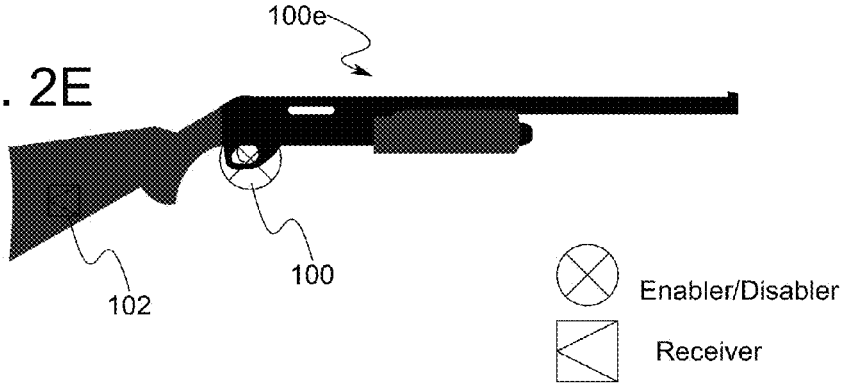

SAFETY SYSTEM ALLOWING PARTIAL ENABLEMENT OF SHOOTING FUNCTIONALITY UPON RECEPTION OF SIGNAL

The present application is an application claiming the benefit under 35 USC Section 119(e) of U.S. Provisional Patent Application Ser. No. 61/643,904, filed May 8, 2012. The present application is based on and claims priority from this application, the disclosure of which is hereby expressly incorporated herein by reference in its entirety.

BACKGROUND OF THE INVENTION

Described herein is a safety that allows at least partial enablement of shooting functionality upon reception of a signal and variations thereof.

Firearms and shooting are inherently dangerous. Patents such as those listed below recognize these dangers and attempt to resolve this.

| Document Number | Publication Date | Patentee |
|---|---|---|
| 4,375,135 | Mar. 01,1983 | Wigger |
| 4,476,644 | Oct. 16, 1984 | Laing |
| 4,682,435 | Jul. 28, 1987 | Heltzel |
| 4,719,713 | Jan. 19, 1988 | Nagle |
| 4,739,569 | Apr. 26, 1988 | Battle |
| 4,829,692 | May 16, 1989 | Guild |
| 5,183,951 | Feb. 02, 1993 | Bilodeau |
| 5,487,234 | Jan. 30, 1996 | Dragon |
| 5,560,135 | Oct. 01, 1996 | Ciluffo |
| 5,603,179 | Feb. 18, 1997 | Adams |
| 5,713,149 | Feb. 03, 1998 | Cady, et al. |
| 5,715,623 | Feb. 10, 1998 | Mackey, III |
| 6,785,996 | Sep. 07, 2004 | Danner, et al. |
| 7,188,444 | Mar. 13, 2007 | Danner, et al. |
| 7,506,468 | Mar. 24, 2009 | Farrell, et al. |
| 2002/0112390 | Aug. 22, 2002 | Harling, et al. |

If firearms are dangerous, lots of firearms are more dangerous. If shooting is dangerous, learning to shoot is more dangerous. If you go to a shooting range establishment, there are lots of firearms around. And often people are learning how to shoot. These beginners don't even know the basics of handling firearms.

BRIEF SUMMARY OF THE INVENTION

Described herein is a safety system that allows at least partial enablement of shooting functionality upon reception of a signal and variations thereof. One exemplary use of this safety system would be in a shooting range establishment training beginner shooters. Another exemplary use of this safety system would be in a home where children reside.

The present safety system may have a plurality of states including "On" (in which all shooting is enabled), "Off" (in which shooting is completely disabled), "Safe" (in which the firearm is enabled if a signal is present), and "Emergency" (in which the firearm is enabled if a signal is present and a secondary safety mechanism is activated).

Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary safety systems and/or provide teachings by which the various exemplary safety systems are more readily understood.

FIGS. 2A-2E are side views of exemplary firearms with representative enablers/disablers and receivers.

Figure 1:
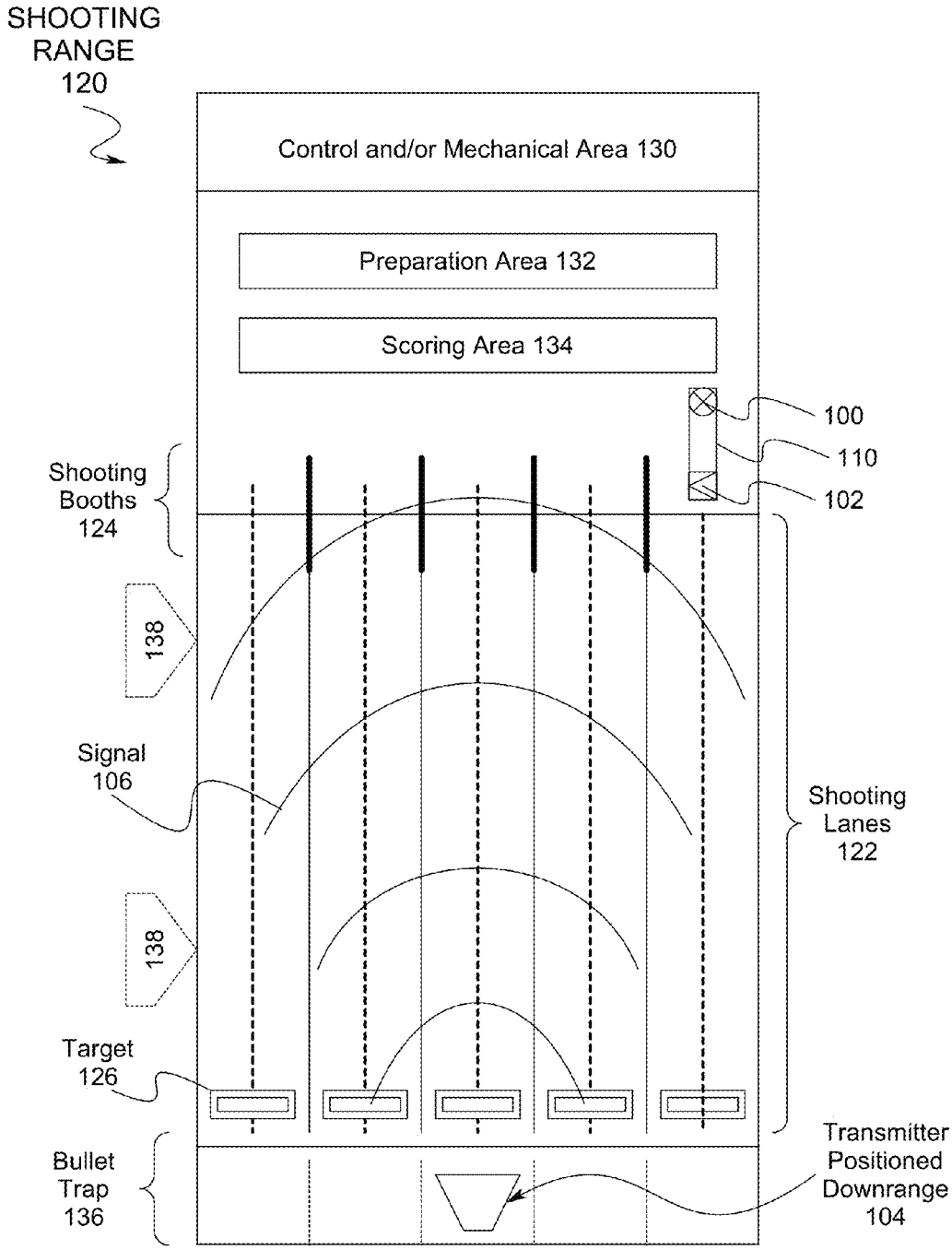
FIG. 1 is a plan view of an exemplary shooting range having transmitters emitting signals.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

Described herein is a safety system allowing at least partial enablement of shooting functionality upon reception of a signal and variations thereof. A system of receivers 100 and enablers/disablers 102 may be associated with a shooter's firearm 110. When the receivers 100 receive signals 106 from a transmitter 104, the enablers/disablers 102 cause the firearm 110 to go into a desired state. Exemplary states include an "On" state 410, "Off" state 420, "Safe" state 430, or "Emergency" state 440.

One exemplary use of this safety system would be in a shooting range establishment training beginner shooters. Another exemplary use of this safety system would be in a home in which children reside. Many other uses will become apparent, some of which are set forth below.

Before describing the safety system and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

Shooting range establishment: A place where multiple people congregate to shoot firearms 110 in a safe manner. FIG. 1 shows an exemplary layout of a shooting range 120 located at a shooting range establishment.

Firearm 110: This would include, for example, shotguns, rifles, pistols, and other shooting devices that shoot projectile ammunition. Theoretically, a firearm 110 may also shoot nonprojectile ammunition. FIGS. 2A-2E show exemplary firearms 110 (shown specifically as 110*a*-100*e*) with associated receivers 100 and enablers/disablers 102.

Enablers/Disablers 102: Much of the known prior art is directed to devices that are used to enable or disable the shooting functionality of a firearm 110. There are many patents discussing how to "lock guns" to prevent the firing of the firearm 110. Examples of these include, but are not limited to U.S. Pat. Nos. 4,682,435, 5,560,135, 5,603,179, and 5,713,149, as well as others set forth herein, known, and yet to be discovered. These devices are collectively referred to as "enablers/disablers 102" and include mechanical, electrical, and other technological solutions that allow the firearm 110 to selectively be enabled (allow for shooting) and disabled (prevented from shooting). Whereas a firearm 110 that is "enabled" is automatically available for shooting, a firearm 110 that is "at least partially enabled" requires a signal from a transmitter 104 or it cannot be shot. Additional requirements are also possible.

Transmitters 104 and Receivers 100: Much of the known prior art makes use of technology for transmitting and receiving signals 106. There are many references discussing how devices transmit signals 106 (referred to generically as "transmitters" 104) and devices to receive signals 106 (referred to generically as "receivers" 100). Examples of these references include U.S. Pat. No. 4,682,435, U.S. Pat. No. 5,183,951, and U.S. Patent Application Publication No. 2002/0112390, as well as others references set forth herein. Other transmitter means and receiver means include mechanical, electrical, and other technological solutions that allow the transmission and reception of signals 106 and may be known or yet to be discovered. Transmitters 104 and receivers 100 may be integrated (joined either literally or functionally as transmitters/receivers 104/100) to allow two-way communication. Directional receivers 100 receive signals from one or more specified or pre-determined directions.

Controlling Communications: Controlling communications may be any type of signal that a receiver 100 uses to communicate to the enabler/disabler to, for example, change the state of the firearm.

The terms "signals," "communications," and/or "transmissions" include various types of information and/or instructions including, but not limited to data, commands, bits, symbols, voltages, currents, electromagnetic waves, magnetic fields or particles, optical fields or particles, and/or any combination thereof. Signals, communications, and transmissions may also be mechanical means to effectuate a particular purpose.

When used in relation to signals 106 and/or communications, the terms "provide" and "providing" (and variations thereof) are meant to include standard means of provision including "transmit" and "transmitting," but can also be used for non-traditional provisions as long as the signal and/or communication is "received" (which can also mean obtained). The terms "transmit" and "transmitting" (and variations thereof) are meant to include standard means of transmission, but can also be used for non-traditional transmissions as long as the signal and/or communication is "sent." The terms "receive" and "receiving" (and variations thereof) are meant to include standard means of reception, but can also be used for non-traditional methods of obtaining as long as the signal and/or communication is "obtained."

The term "associated" is defined to mean integral or original, retrofitted, attached, connected (including functionally connected), positioned near, and/or accessible by.

Unless specifically stated otherwise, the term "exemplary" is meant to indicate an example, representative, and/or illustration of a type. The term "exemplary" does not necessary mean the best or most desired of the type.

Unless specifically stated otherwise, the terms "first," "second," and "third" are meant solely for purposes of designation and not for order or limitation. Similarly, it should be noted that relative terms (e.g. primary and secondary) are meant to help in the understanding of the technology and are not meant to limit the scope of the invention. Similarly, the term "front" is meant to be relative to the term "back" and the term "top" is meant to be relative to the term "bottom."

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, or comprises A and B contains A and B, but optionally may contain C or additional components other than A and B). It should be noted that, unless otherwise specified, the singular forms "a," "an," and "the" refer to one or more than one, unless the context clearly dictates otherwise.

It should be noted that there are many concerns associated with firearm safety devices. Not all solutions are applicable for every situation. For military and police uses, the firearm must be able to be fired at all times, so the normal state of safety devices for these applications is generally "enabled." For applications in which the firearm is only used under certain conditions or at certain times, the firearm may be locked (disabled), and the unlocking may require certain actions or steps by the user. For example, a collector's firearm, a broken firearm that needs repair, or a hunting rifle that would only be used on rare occasions would not need to be immediately available for use and could have a relatively complicated locking safety device.

Figure 3:
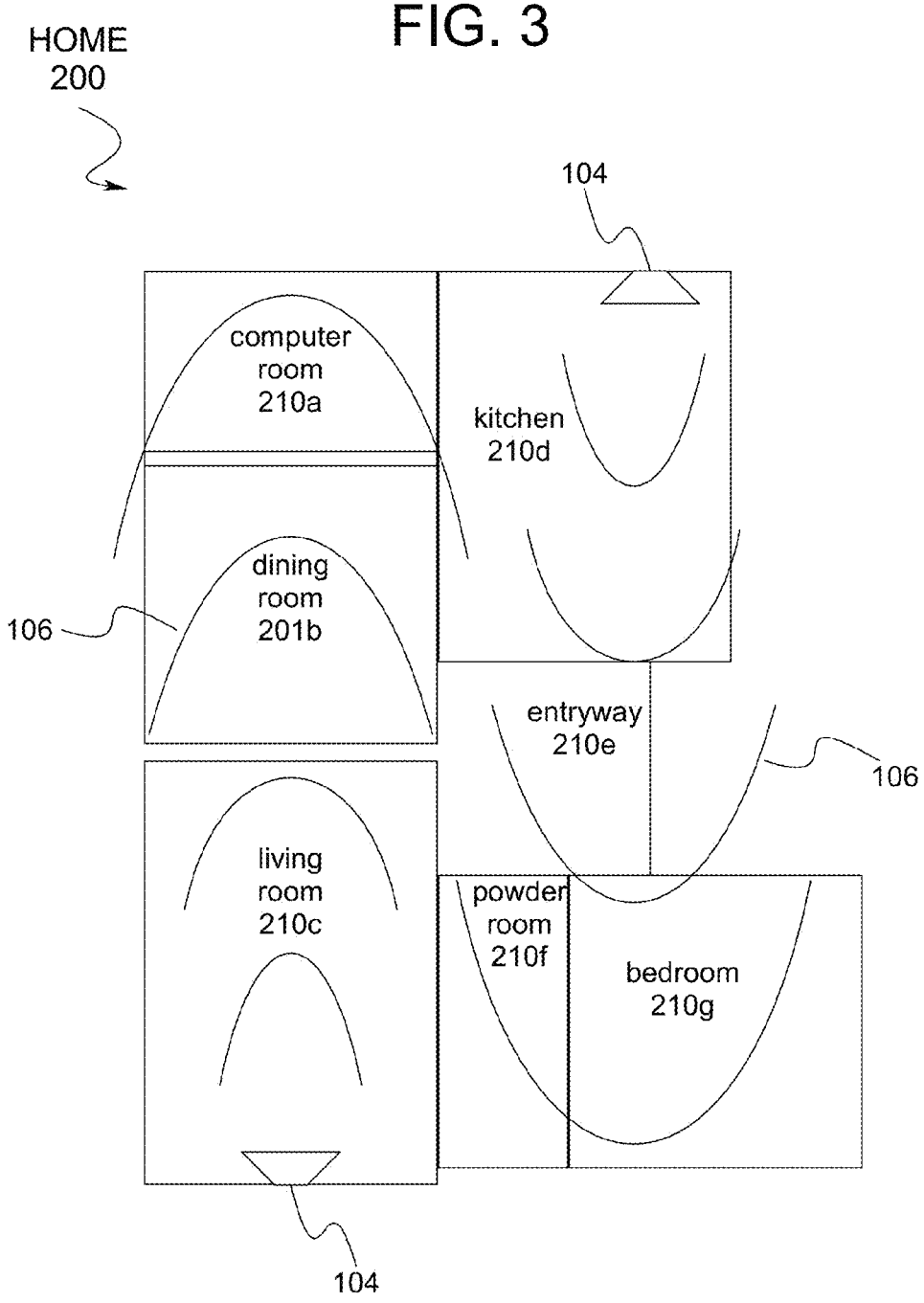
FIG. 3 is a plan view of an exemplary home having transmitters emitting signals.

The present safety system is for use with firearms 110 (shown in FIGS. 2A-2E as firearms 110*a*-110*e*) that should be available for shooting (enabled) under certain circumstances, but prevented from firing (disabled) under other circumstances. The circumstances would be at least partially determinable based on location or direction. For example, in a shooting range 120 (as shown in FIG. 1), an exemplary firearm 110 would only be able to be shot when it is pointed downrange in a formal shooting lane 122 and the lane is clear. Another example would be when a homeowner is at home (as shown in FIG. 3) in an emergency situation.

Figure 4:
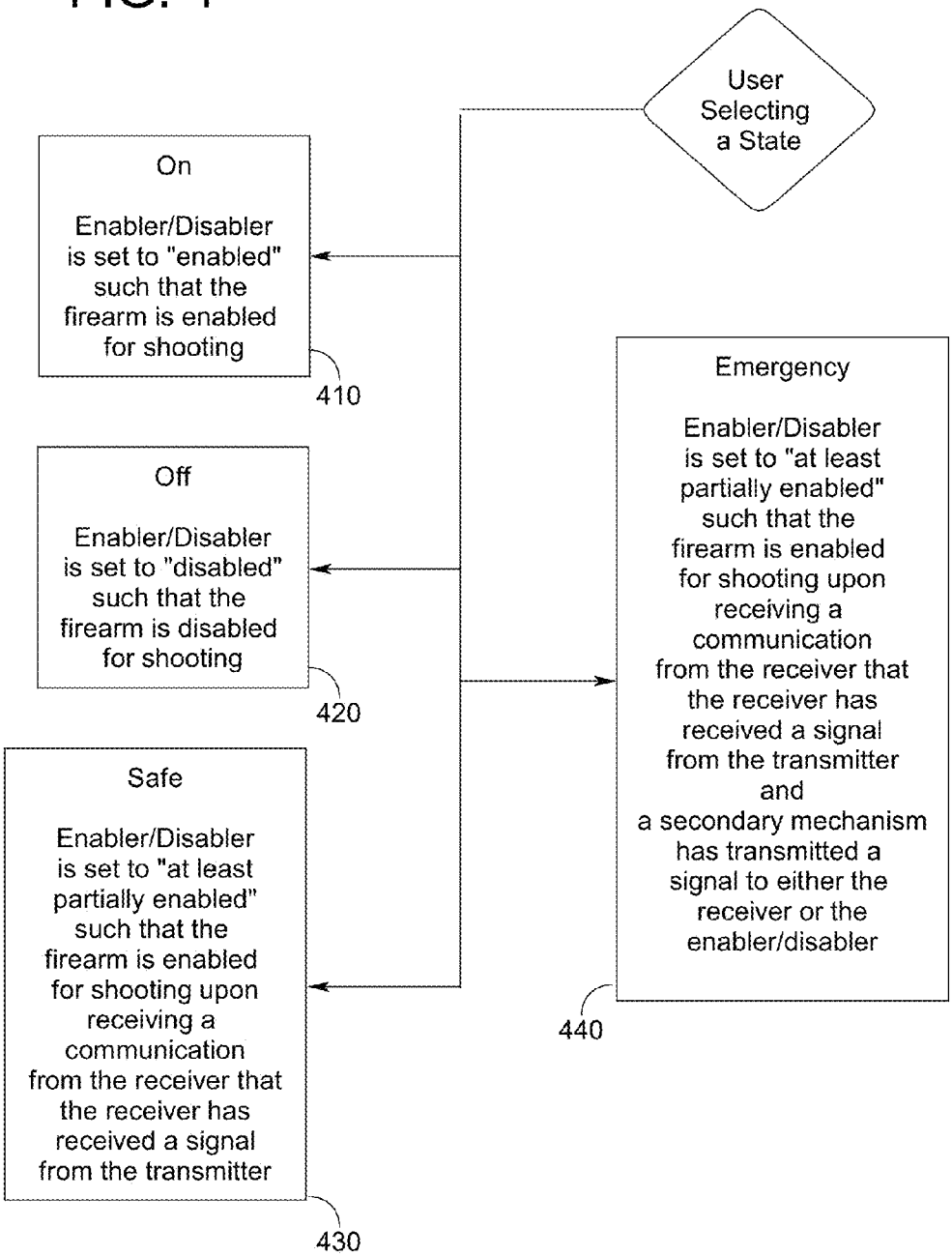
FIG. 4 is a flow chart showing exemplary states of a system described herein.

As shown in FIG. 4, the present safety system may have a plurality of states including an "On" state 410 (in which all shooting is enabled), an "Off" state 420 (in which shooting is completely disabled), a "Safe" state 430 (in which the firearm 110 is enabled if a signal 106 is present), and an "Emergency" state 440 (in which the firearm 110 is enabled if a signal 106 is present and a secondary safety mechanism is activated).

Safety System for a Shooting Range Establishment

Shooting range establishments are always looking for ways to reduce their liability. A shooting range establishment could sell, rent, loan, or provide free of charge receivers 100 and enablers/disablers 102 that can be associated with shooters' firearms 110. Providing or otherwise requiring safety system implementation would make the shooting range establishment much safer. A shooting range establishment could require the safety system for all users or just for children and/or novice shooters. Shooting range establishments could also rent, loan, or provide free of charge firearms with receivers 100 and enablers/disablers 102 already associated therewith. These firearms 110 would be less likely to be stolen because of their associated safety systems that would not allow firing of the firearm 110 without the presence of the signal 106.

FIG. 1 shows an exemplary shooting range 120 that includes a plurality of shooting lanes 122, each shooting lane 122 having a shooting booth 124 at a first end and a target 126 at a second end (downrange). The shooting range may also include a control and/or mechanical area 130, a preparation area 132, a scoring area, 134, and/or a bullet trap 136 (downrange).

In a safety system for a shooting range establishment, the safety system may only include the "Safe" state 430. Alternatively, the safety system could include the "Off" state 420 and "Safe" state 430. Yet another alternative would have the safety system including the "On" state 410, "Off" state 420, and "Safe" state 430. Finally, the safety system could include the "On" state 410, "Off" state 420, "Safe" state 430, and "Emergency" state 440.

A first exemplary safety system for a shooting range includes at least one transmitter 104 (FIG. 1) and a directional receiver 100 associated with a firearm 110. The transmitter 104 is positioned downrange of the shooting booth 122. The transmitter 104 may always be on or, preferably, either manually or automatically monitored so that it is turned on only when the shooting lanes 124 are clear. (Automatic monitoring may be accomplished using, for example, using optional detectors 138 known and yet to be discovered that are capable of detecting the presence of a person. Exemplary detectors 138 include motion detectors or beam detectors (that detect a break in the beam, similar to those used to prevent a garage door from closing if a child is under the door).) The directional receiver 100 is in communication with the enabler/disabler 102 associated with the firearm 110. If the directional receiver 100 receives a signal from the transmitter 104, the directional receiver 100 communicates (using a controlling communication) to the enabler/disabler that the firearm 110 should be at least partially enabled (available for shooting with the presence of the signal from the transmitter 104). (Appropriate communication signals and control signals would be sent by the receiver 100 and received by the enabler/disabler 102 to effectuate this purpose.)

A second exemplary safety system for a shooting range establishment includes at least one transmitter 104 and a directional receiver 100 associated with a firearm 110. The transmitter 104 is positioned everywhere but downrange of the shooting range. The directional receiver 100 is in communication with the enabler/disabler associated with the firearm 110. In this example, the enabler/disabler 102 is configured such that the firearm 110 is only available for shooting if the directional receiver 100 does not receive a signal 106 from the transmitter 104.

A variation on these first and second exemplary safety systems would be to include an alarm on the firearm 110. If the receiver 100 on the firearm 110 either senses or doesn't sense (depending on the position of the transmitter 104) a signal, the alarm on the firearm 110 sounds. Using this variation, if the user is pointing the firearm 110 in the wrong direction, there will be an alarm (e.g. an audible or visual alarm). Using this variation, not only would the firearm 110 be safer, but the alarm would provide feedback to instructors who could admonish young and novice shooters and provide reminders as to safety.

Safety System for a Home

The dilemma of having a firearm 110 in a home is that the user wants it to be available for use in an emergency, but does not want it to be available for unauthorized use by children or intruders. Also, firearm owners worry about the malfeasance that might be caused by a stolen firearm. A firearm 110 having an associated safety system such as one disclosed herein (particularly a safety system having an "Emergency" state) would be usable by an owner in an emergency, but unauthorized uses would be thwarted and stolen firearms 110 would be disabled.

FIG. 3 shows an exemplary home 200 having a plurality of rooms 210*a*-210*g*. The home has at least one transmitter 104 associated therewith. It should be noted that the transmitter 104 could also be outside the home (e.g. a satellite signal that provides location information).

In a safety system for a home, the safety system may only include the "Emergency" state 440. Alternatively, the safety system could include the "Off" state 420 and the "Emergency" state 440. Yet another alternative would have the safety system including the "On" state 410, "Off" state 420, and "Emergency" state 440. Finally, the safety system could include the "On" state 410, "Off" state 420, "Safe" state 430, and "Emergency" state 440.

An exemplary safety system for a home includes at least one transmitter 104 (shown as two in FIG. 3) and a receiver 100 associated with a firearm 110. The transmitter 104 may be a special transmitter designed for the safety system, or it may be a transmitter already in a home (e.g. an internet signal providing device (WiFi transmitter) or a signal provided by "roam phones"). The receiver 100 is in communication with the enabler/disabler associated with the firearm 110. If the receiver 100 receives a signal from the transmitter 104, the receiver 100 communicates (using controlling communications) to the enabler/disabler that the firearm 110 should be at least partially enabled (available for shooting with the presence of the signal from the transmitter 104 and a secondary safety mechanism). (Appropriate communication signals and/or control signals would be sent by the receiver 100 and received by the enabler/disabler 102 to effectuate this purpose.) The secondary safety mechanism might be, for example, a code, a biometric mechanism, a voice authenticating mechanism, a mechanism capable of sensing and recognizing series of actions, a key, or any other secondary safety mechanism. (Appropriate communication signals and/or control signals would be sent by the secondary mechanism and received by the enabler/disabler 102 to effectuate this purpose.) In other words, a firearm 110 having the receiver 100 described herein would not fire outside of the home 200 because there would be no signal 106 but, even within the home, a secondary safety mechanism would prevent accidental discharge of the firearm 110.

Variations on this system could include variations similar to those described in relation to the shooting range configuration. Another variation suitable for a transmitter 104 positioned outside the home (e.g. a satellite signal that provides location information) would be to use a receiver 100 that has GPS capabilities. Another variation would be an alarm that sounded if the receiver 100 senses that the firearm 110 has been moved. (The receiver 100 in such a case would be able to determine either motion and/or location.) This "alarm" could send a communication (e.g. phone call or text message) to a predetermined number so that a parent would know if there had been unauthorized tampering with the firearm 110.

Flowchart

FIG. 4 is a flow chart illustrating exemplary states, methods, and/or systems such as those described herein. It will be understood that each block of the flow chart, components of all or some of the blocks of the flow chart, and/or combinations of blocks in the flow chart, may be implemented by software (e.g. coding, software, computer program instructions, software programs, subprograms, or other series of computer-executable or processor-executable instructions), by hardware (e.g. processors, memory), by firmware, and/or a combination of these forms. As an example, in the case of software, computer program instructions (computer-readable program code) may be loaded onto a computer to produce a machine, such that the instructions that execute on the computer create structures for implementing the functions specified in the flow chart block or blocks. These computer program instructions may also be stored in a memory that can direct a computer to function in a particular manner, such that the instructions stored in the memory produce an article of manufacture including instruction structures that implement the function specified in the flow chart block or blocks. The computer program instructions may also be loaded onto a computer to cause a series of operational steps to be performed on or by the computer to produce a computer implemented process such that the instructions that execute on the computer provide steps for implementing the functions specified in the flow chart block or blocks. The term "loaded onto a computer" also includes being loaded into the memory of the computer or a memory associated with or accessible by the computer. The term "memory" is defined to include any type of computer (or other technology)-readable media including, but not limited to attached storage media (e.g. hard disk drives, network disk drives, servers), internal storage media (e.g. RAM, ROM), removable storage media (e.g. CDs, DVDs, flash drives, memory cards, floppy disks), and/or other storage media known or yet to be discovered. The term "computer" is meant to include any type of processor, programmable logic device, or other type of programmable apparatus known or yet to be discovered. Accordingly, blocks of the flow charts support combinations of steps, structures, and/or modules for performing the specified functions. It will also be understood that each block of the flow charts, and combinations of blocks in the flow charts, may be divided and/or joined with other blocks of the flow charts without affecting the scope of the invention. This may result, for example, in computer-readable program code being stored in whole on a single memory, or various components of computer-readable program code being stored on more than one memory.

This system can be built by a combination of innovative programming and known devices including commercially available components as well as technology disclosed in U.S. Pat. Nos. 4,375,135, 4,476,644, 4,682,435, 4,719,713, 4,739,569, 4,829,692, 5,183,951, 5,487,234, 5,560,135, 5,603,179, 5,713,149, 5,715,623, 6,785,996, 7,188,444, and 7,506,468 and U.S. Patent Publication No. 2002/0112390.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not.

All references (including, but not limited to, patents, publications, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A safety system in combination with a firearm and a shooting range, comprising:

(a) at least one transmitter for emitting a signal;

(b) said shooting range comprising:

(i) an uprange shooting area where said firearm is fired; and (ii) a downrange target area where said target is positioned, said at least one transmitter positioned in said downrange target area;

(c) a directional receiver associated with said firearm, said directional receiver capable of receiving said signal from said at least one transmitter when pointed in the direction of said transmitter;

(d) an enabler/disabler associated with said firearm;

(e) said directional receiver in controlling communication with said enabler/disabler; and (f) said enabler/disabler at least partially enabling said firearm such that said firearm is available for shooting upon receipt of a controlling communication from said directional receiver, said directional receiver transmitting said controlling communication in response to the receipt of said signal from said at least one transmitter.

2. The safety system of claim 1, the at least partially enabled firearm being available for shooting when said firearm is pointed in a safe direction.

3. The safety system of claim 1, the at least partially enabled firearm being available for shooting with the presence of said signal from said at least one transmitter.

4. The safety system of claim 1, the at least partially enabled firearm being available for shooting with the presence of said signal from said at least one transmitter and, in addition, a secondary safety mechanism is activated.

5. The safety system of claim 1, the at least partially enabled firearm being available for shooting with the presence of said signal from said at least one transmitter and, in addition, a secondary safety mechanism is activated, said secondary safety mechanism selected from the group consisting of a code, a biometric mechanism, a voice authenticating mechanism, a mechanism capable of sensing and recognizing series of actions, and a key.

6. The safety system of claim 1 further comprising an alarm, said alarm activating when the firearm is pointed in an unsafe direction.

7. A safety system in combination with a firearm and a shooting range, comprising:

(a) at least one transmitter for emitting a signal;

(b) said shooting range comprising:

(i) an uprange shooting area where said firearm is fired, said at least one transmitter positioned in said uprange target area; and (ii) a downrange target area where said target is positioned;

(c) a directional receiver associated with said firearm, said directional receiver capable of receiving said signal from said at least one transmitter when pointed in the direction of said at least one transmitter;

(d) an enabler/disabler associated with said firearm;

(e) said directional receiver in controlling communication with said enabler/disabler; and (f) said enabler/disabler at least partially enabling said firearm such that said firearm is available for shooting when said firearm is pointed in a safe direction.

8. The safety system of claim 7, the at least partially enabled firearm being available for shooting with the presence of said signal from said at least one transmitter.

9. The safety system of claim 7, the at least partially enabled firearm being available for shooting with the absence of said signal from said at least one transmitter.

10. The safety system of claim 7, the at least partially enabled firearm being available for shooting with the presence of said signal from said at least one transmitter and, in addition, a secondary safety mechanism is activated.

11. The safety system of claim 7, the at least partially enabled firearm being available for shooting with the presence of said signal from said at least one transmitter and, in addition, a secondary safety mechanism is activated, said secondary safety mechanism selected from the group consisting of a code, a biometric mechanism, a voice authenticating mechanism, a mechanism capable of sensing and recognizing series of actions, and a key.

12. The safety system of claim 7 further comprising an alarm, said alarm activating when the firearm is pointed in an unsafe direction.

13. The safety system of claim 7, the at least partially enabled firearm being available for shooting with the absence of said signal from said at least one transmitter and, in addition, a secondary safety mechanism is activated.

14. A safety system in combination with a firearm and a shooting range, said firearm capable of shooting, said safety system comprising:

(a) at least one transmitter for emitting a signal;

(b) said shooting range having an uprange shooting area where said firearm is fired and a downrange target area where said target is positioned, said at least one transmitter positioned in a predetermined location selected from said uprange shooting area and said downrange target area;

(c) a receiver associated with said firearm, said receiver for receiving said signal from said at least one transmitter;

(c) an enabler/disabler associated with said firearm, said enabler/disabler for at least partially enabling said firearm such that said firearm is available for shooting when said firearm is pointed toward said downrange target area;

(d) said receiver in controlling communication with said enabler/disabler, said receiver using controlling communications to communicate with said enabler/disabler; and (e) wherein said safety system has at least one state selected from the group consisting of:

(i) a "Safe" state in which said enabler/disabler at least partially enables said firearm such that said firearm is available for shooting when said receiver receives a signal from said at least one transmitter and said receiver provides a controlling communication to said enabler/disabler; and (ii) an "Emergency" state in which said enabler/disabler at least partially enables said firearm such that said firearm is available for shooting when said receiver receives a signal from said at least one transmitter and said receiver provides a controlling communication to said enabler/disabler and, in addition, a secondary safety mechanism is activated.

15. The safety system of claim 14 in which said safety system further has an "On" state in which all shooting is enabled.

16. The safety system of claim 14 in which said safety system further has an "Off" state in which shooting is completely disabled.

17. The safety system of claim 14 in which said safety system further has an "On" state in which all shooting is enabled and an "Off" state in which shooting is completely disabled.

18. The safety system of claim 14 in which said safety system has both said "Safe" state and said "Emergency" state.

19. The safety system of claim 14, said secondary safety mechanism selected from the group consisting of a code, a biometric mechanism, a voice authenticating mechanism, a mechanism capable of sensing and recognizing series of actions, and a key.

20. The safety system of claim 14, said enabler/disabler selected from a group comprising:

(a) an enabler/disabler for at least partially enabling said firearm with the presence of a signal from said at least one transmitter and said at least one transmitter is in a positioned in a predetermined location in said downrange target area;

(b) an enabler/disabler for at least partially enabling said firearm with the absence of a signal from said at least one transmitter and said at least one transmitter is in a positioned in a predetermined location in said downrange target area;

(c) an enabler/disabler for at least partially enabling said firearm with the presence of a signal from said at least one transmitter and said at least one transmitter is in a positioned in a predetermined location in said uprange target area; and (d) an enabler/disabler for at least partially enabling said firearm with the absence of a signal from said at least one transmitter and said at least one transmitter is in a positioned in a predetermined location in said uprange target area.

* * * * *